United States Patent [19]

Komada

[11] 4,374,458

[45] Feb. 22, 1983

[54] METHOD OF CONNECTING A CO-AXIAL CABLE TO A CONNECTOR

[76] Inventor: Hitoshi Komada, 28-3, Oaza Saito Aza Shimoiseji, Fuso-cho, Niwa-gun, Aichi-ken, Japan

[21] Appl. No.: 222,941

[22] Filed: Jan. 6, 1981

Related U.S. Application Data

[63] Continuation of Ser. No. 41,298, May 22, 1979.

[30] Foreign Application Priority Data

Jun. 13, 1978 [JP] Japan ..... 53-71657

[51] Int. Cl.[3] ..... H01R 43/00

[52] U.S. Cl. ..... 29/857; 29/854; 174/75 C; 339/100

[58] Field of Search ..... 339/100, 89 C, 177 E, 339/177 R, 221 R; 29/854, 828, 857; 174/75 C, 89, 88 C

[56] References Cited

U.S. PATENT DOCUMENTS 3,603,912 9/1971 Kelly ..... 339/89 C
4,156,554 5/1979 Aujla .

FOREIGN PATENT DOCUMENTS 1285750 1/1962 France ..... 339/100

*Primary Examiner*—Francis S. Husar
*Assistant Examiner*—Carl J. Arbes
*Attorney, Agent, or Firm*—Dennison, Meserole, Pollack & Scheiner

[57] ABSTRACT

A method of connecting a coaxial cable to a wiring appliance to which a plurality of electrodes are integrally secured via insulating materials. The method comprises the steps of severing an end of the coaxial cable smoothly against the axis thereof, putting the severed end into contact with the wiring appliance, connecting the electrodes with inner and outer conductors exposed on the severed end of the coaxial cable and securing the coaxial cable to the wiring appliance.

3 Claims, 8 Drawing Figures

FIG. 4
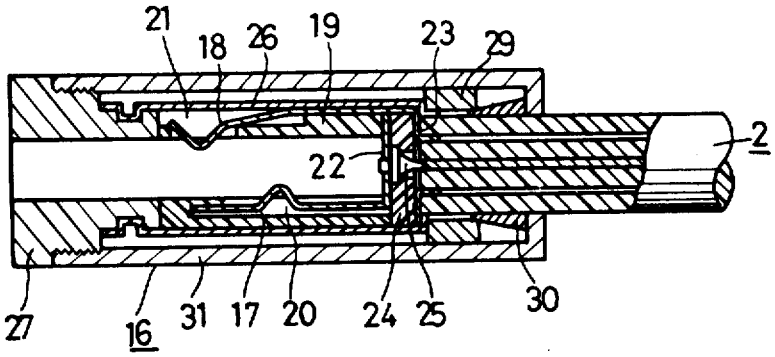
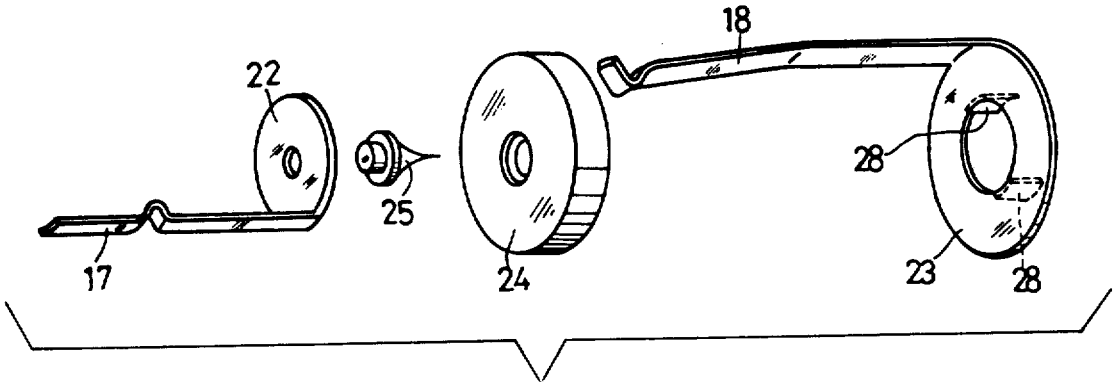
FIG. 5

METHOD OF CONNECTING A CO-AXIAL CABLE TO A CONNECTOR

This is a continuation of application Ser. No. 41,298, filed May 22, 1979.

BACKGROUND OF THE INVENTION

1. Field of the Invention

The present invention relates to a method of connecting a coaxial cable to wiring appliances such as various types of plugs, jacks and connectors without utilizing solder.

2. Description of the Prior Art

In a general method of connecting a coaxial cable to a wiring appliance such as a plug, outer and inner insulating covers of the cable are gradually stripped away and the outer and inner conductors are respectively connected by solder to electrodes of the wiring appliance. In such a method, however, it takes much time to gradually strip the relatively thick outer insulating cover, the outer conductor which is a cylindrical mesh conducting wire and the inner insulating cover and solder the outer and inner conductors to electrodes of the appliance, leading to an increase in cost of electrical appliances.

SUMMARY OF THE INVENTION

The present invention is contemplated overcoming the aforementioned disadvantages of the prior art.

It is an object of the present invention to provide a method of connecting a coaxial cable to a wiring appliance without stripping the insulating covers of the coaxial cable.

It is another object of the present invention to provide a method of connecting a coaxial cable to a wiring appliance without utilizing solder.

According to the method of the present invention, a coaxial cable is connected to a wiring appliance such as a plug, a jack and a connector to which a plurality of electrodes such as a plus terminal and a pair of earth terminals are integrally secured via insulating materials. An end of the coaxial cable is severed perpendicularly, diagonally, curvedly or triangularly against its central axis to have a smooth surface and put into contact with the wiring appliance along its axial direction to connect said electrodes of the wiring appliance with the outer and inner conductors exposed on the severed smooth surface of the coaxial cable. Then the coaxial cable is secured to the wiring appliance by a cylindrical case which is threadedly connected to the wiring appliance through a tapered member or clamped against the coaxial cable.

BRIEF DESCRIPTION OF THE DRAWINGS

FIG. 4 is a fragmentary side elevational view of a second embodiment of the method of the present invention;

FIG. 5 is an enlarged exploded perspective view of a plus lead plate, an earth lead plate and an insulator as shown in FIG. 4;

DESCRIPTION OF THE PREFERRED EMBODIMENTS

Figure 1:
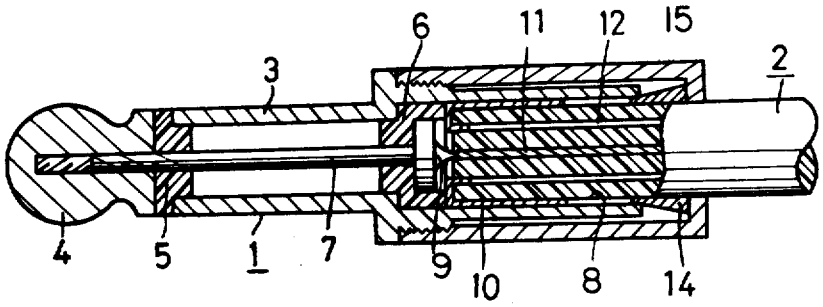
FIG. 1 is a fragmentary side elevational view of a first embodiment of the method of the present invention.
Figure 2:
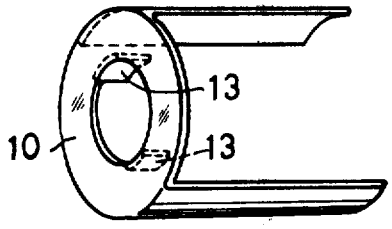
FIG. 2 is an enlarged perspective view of an interconnecting terminal as shown in FIG. 1.
Figure 3:
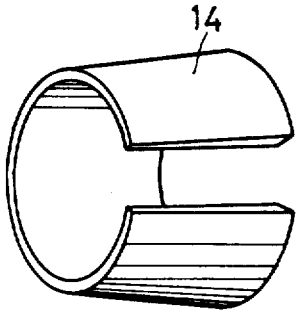
FIG. 3 is an enlarged perspective view of a tapered member as shown in FIG. 1.

Attention is now drawn to FIGS. 1 to 3 of the drawings, in which a first embodiment of the method according to the present invention is shown. In FIG. 1, numeral 1 indicates a plug to be connected with a coaxial cable 2. The plug 1 comprises a cylindrical member 3 forming an earth electrode and a spherical member 4 forming a plus electrode. The cylindrical member 3 is integrally connected with the spherical member 4 by a clamp bar 7 which is threadedly inserted into the spherical member 4. A pair of insulators 5 and 6 are interposed between the cylindrical member 3 and the spherical member 4 and between the cylindrical member 3 and the clamp bar 7 for insulation purposes. The cylindrical member 3 has in its rear part a through-hole 8 for receiving the coaxial cable 2, into which a pin-shaped plus terminal 9 is projected from the clamp bar 7. An interconnecting terminal 10 forming an earth electrode is inserted in the through-hole 8 to contact the inner wall thereof. As shown in FIG. 2, the interconnecting terminal 10 has a pair of earth terminals 13 inwardly protruding in a radial direction around the plus terminal 9, i.e., the radial direction of an outer conductor 12 of the cable 2 concentrically enclosing an inner conductor 11.

In operation, an end of the coaxial cable 2 is severed perpendicularly to the axis thereof, and inserted under pressure into the through-hole 8. In this condition, the plus terminal 9 is inserted in the inner conductor 11 of the cable 2 and the earth terminals 13 are inserted in the outer conductor 12 to connect the inner and outer conductors 11 and 12 with the spherical member 4 and the cylindrical member 3 respectively. Thereafter a cylindrical case 15 forming a grip is threadedly connected to the cylindrical member 3 through a tapered member 14 which is C-shaped in section as shown in FIG. 3, to secure the coaxial cable 2 to the cylindrical member 3 of the plug 1 and thereby assure connection of the inner and outer conductors 11 and 12 with the spherical member 4 and the cylindrical member 3.

In a second embodiment as shown in FIGS. 4 and 5, the coaxial cable 2 is connected with a jack 16 having a plus lead plate 17 forming a plus electrode and an earth lead plate 18 forming an earth electrode, which are, respectively, engaged in an inner groove 20 and an outer groove 21 of an inner cylinder 19 made of insulating material. An insulator 24 and a pin-shaped plus terminal 25 are interposed between bent portions 22 and 23 of the lead plates 17 and 18, which are inserted in an outer cylinder 26 calked by a base 27 for receiving a plug.

In this condition, the plus terminal 25 contacting the plus lead plate 17 is projected through the center of the insulator 24 defining the end surface of the outer cylinder 26, and a pair of earth terminals 28 protrude integrally from the earth lead plate 18 in a radial direction around the center thereof, i.e., the radial direction of the outer conductor 12 of the cable 2 concentrically enclosing the inner conductor 11.

In operation, an end of the coaxial cable 2 is severed perpendicularly to the axis thereof, and put into contact with the insulator 24. In this condition, the plus terminal 25 is inserted in the inner conductor 11 of the cable 2 and the earth terminals 28 are inserted in the outer conductor 12 to connect the inner and outer conductors 11 and 12 with the plus lead plate 17 and the earth lead plate 18 respectively. Thereafter a cylindrical case 31 forming a grip is threadedly connected to the base 27 through a ring 29 and a tapered member 30 which is C-shaped in section to prevent the coaxial cable 2 from moving in the axial direction thereof, and thereby assure connection of the inner and outer conductors 11 and 12 with the plus lead plate 17 and the earth lead plate 18.

Figure 6:
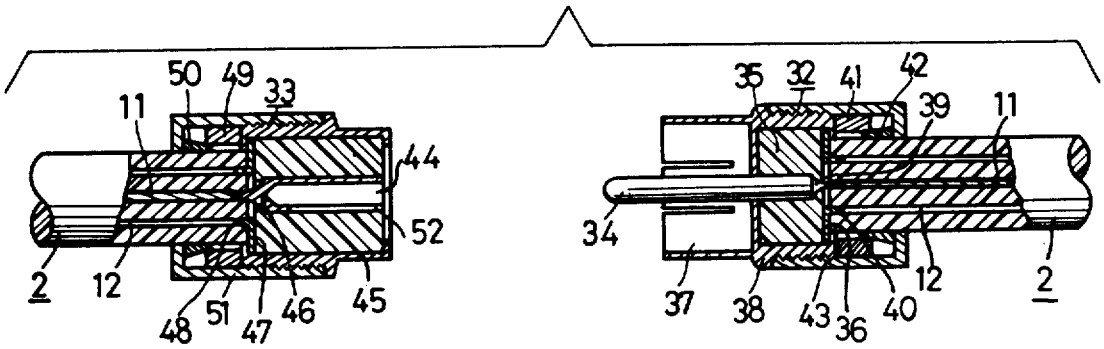
FIG. 6 is a fragmentary side elevational view of a third embodiment of the method of the present invention.

FIG. 6 shows a third embodiment of the method of the present invention in which the cable 2 is connected with an RCA-type plug 32 and a jack 33. An insulator 35 into which a plus electrode bar 34 of the plug 32 is inserted under pressure and an earth electrode plate 36 are calked by a cylinder 38 forming an earth electrode which is integral with a socket 37. In this condition, a pin-shaped plus terminal 39 formed integrally with the electrode bar 34 and insulated from the cylinder 38 and the electrode plate 36 and a pair of earth terminals 40 formed integrally with the electrode plate 36 contacting the cylinder 38 protrude outwardly from the insulator 35.

In operation, a perpendicularly severed end of the coaxial cable 2 is put into contact with the electrode plate 36 under pressure to get the plus terminal 39 and the earth terminals 40 inserted in the inner and outer conductors 11 and 12 respectively and thereby connect the inner and outer conductors 11 and 12 with the plus electrode bar 34 and the socket 37 forming the earth electrode respectively. Thereafter a cylindrical case 43 forming a grip is threadedly connected to the cylinder 38 through a ring 41 and a tapered member 42 which is C-shaped in section to prevent the coaxial cable 2 from moving in the axial direction thereof, and thereby assure connection of the inner and outer conductors 11 and 12 with the electrode bar 34 and the socket 37 respectively.

In a similar manner, an electrode holder 44 for a plus electrode and a cylinder 45 forming an earth electrode constituting the jack 33 are respectively connected with the inner and outer conductors 11 and 12 through a plus terminal 46 formed integrally with the electrode holder 44 and a pair of earth terminals 48 formed integrally with an electrode plate 47 contacting the cylinder 45. To assure the connection, the coaxial cable 2 is secured to the cylinder 45 by a ring 49, a tapered member 50 which is C-shaped in section and a cylindrical case 51 forming a grip.

In FIG. 6, numeral 52 indicates a slit for purging air from the electrode holder 44 when the electrode bar 34 is inserted thereinto.

Figure 7:
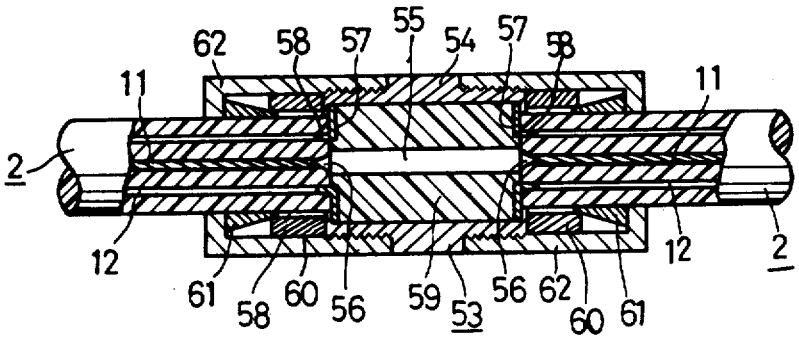
FIG. 7 is a fragmentary side elevational view of the fourth embodiment of the method of the present invention.

FIG. 7 shows a fourth embodiment of the method of the present invention in which two coaxial cables 2 are connected with each other through a connector 53. A pair of plus terminals 56 formed on both ends of a plus electrode bar 55 and two pairs of earth terminals 58 formed on both ends of an earth electrode plate 57 and insulated from the plus terminals 56 by an insulator 59 protrude from both ends of a cylinder 54 forming an earth electrode. The inner conductors 11 and the outer conductors 12 of the coaxial cables 2 are respectively connected with the plus terminals 56 and the earth terminals 58 under pressure, and the cables 2 are secured to the cylinder 54 by rings 60, tapered members 61 which are C-shaped in section and cylindrical cases 62 forming grips. The construction, function and effect of this embodiment are substantially identical with those of the third embodiment as shown in FIG. 6.

Figure 8:
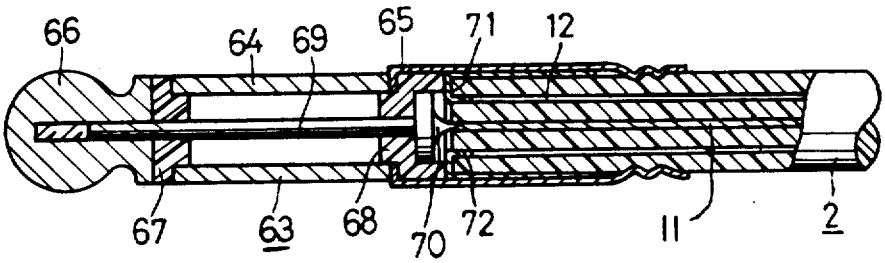
FIG. 8 is a fragmentary side elevational view of the fifth embodiment of the method of the present invention.

FIG. 8 shows a fifth embodiment of the method of the present invention in which the coaxial cable 2 is connected with a plug 63. The plug 63 comprises a cylindrical member 64 forming an earth electrode, a cylindrical case 65 forming a grip and a spherical member 66 forming a plus electrode. The three elements are integrally connected with one another by a clamp bar 69 forming a plus electrode which is threadedly inserted into the spherical member 66 with interposition of a pair of insulators 67 and 68 for insulation purposes. The inner and outer conductors 11 and 12 of the cable 2 are put into contact with a plus terminal 70 formed in an end of the clamp bar 69 and a pair of earth terminals 72 formed integrally with an earth electrode plate 71 inserted in the case 65 respectively, and the rear part of the case 65 is clamped against the cable 2 to assure connection of the cable 2 and the plug 63. The construction, function and effect of this embodiment are substantially identical with those of the first embodiment.

In each of the aforementioned embodiments of the present invention, each conductor can be bonded to each terminal while maintaining fitting of the conductor and the terminal by discharging electricity such as condenser energy therebetween.

While the invention has been described with reference to a few preferred embodiments thereof, it is to be understood that modifications or variations may be easily made without departing from the scope of this invention which is defined by the appended claims.

What is claimed is:

1. A method of connecting a coaxial cable having an outer circumferential ground shield and a central conductor to an electrical connector such as a phone plug or jack having a plurality of electrodes integrally secured therein and insulated from each other, said method comprising the steps of:

severing across the entire end of said coaxial cable smoothly normal to the longitudinal axis thereof to provide a single flat end face thereon and exposing only the end faces of said shield and central conductor;

axially moving said single severed flat end of said coaxial cable into contact with said electrical connector;

forcibly connecting said electrodes axially with the inner conductor and outer shield end faces exposed on said flat severed end of said coaxial cable; and concurrently tightly securing the body of said coaxial cable to said electrical connector.

2. The method as defined in claim 1 wherein said coaxial cable is secured to said electrical connector by a cylindrical case clamped against said coaxial cable.

3. The method as defined in claim 1 wherein said coaxial cable is secured to said electrical connector by interposing a C-shaped tapered member between said wiring appliance into which said coaxial cable is inserted and a cylindrical member is placed over the end of said cable and said tapered member and is threadedly connected to said connector thereby forcing said tapered member against said coaxial cable.

* * * * *